US010104477B2

(12) United States Patent
Ogata et al.

(10) Patent No.: US 10,104,477 B2
(45) Date of Patent: Oct. 16, 2018

(54) SPEAKER FOR GENERATING SOUND BASED ON DIGITAL SIGNAL

(71) Applicant: DAI-ICHI SEIKO CO., LTD., Kyoto-shi, Kyoto (JP)

(72) Inventors: Kenji Ogata, Ogori (JP); Akihiko Hosaka, Chiyoda-ku (JP); Yoshiyuki Watanabe, Chiyoda-ku (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/577,257

(22) PCT Filed: May 23, 2016

(86) PCT No.: PCT/JP2016/065205
§ 371 (c)(1),
(2) Date: Nov. 27, 2017

(87) PCT Pub. No.: WO2016/194683
PCT Pub. Date: Dec. 8, 2016

(65) Prior Publication Data

US 2018/0167743 A1 Jun. 14, 2018

(30) Foreign Application Priority Data

May 30, 2015 (JP) ..... 2015-110980

(51) Int. Cl.
*H04R 1/32* (2006.01)
*H04R 17/00* (2006.01)
(Continued)

(52) U.S. Cl.
CPC ..... *H04R 17/00* (2013.01); *H04R 1/323* (2013.01); *H04R 7/04* (2013.01); *H04R 7/06* (2013.01); *H04R 3/00* (2013.01)

(58) Field of Classification Search
CPC . H04R 17/00; H04R 3/00; H04R 7/04; H04R 1/323; H04R 7/06
See application file for complete search history.

(56) References Cited

U.S. PATENT DOCUMENTS 4,384,230 A * 5/1983 Wisner ..... H01L 41/042 310/317
2008/0079332 A1* 4/2008 Rorick ..... B06B 1/0607 310/334
(Continued)

FOREIGN PATENT DOCUMENTS

JP 58-104598 A 6/1983
JP 59-189800 A 10/1984
(Continued)

OTHER PUBLICATIONS

International Search Report, PCT/JP2016/065205, dated Aug. 9, 2016.
Written Opinion, PCT/JP2016/065206, dated Aug. 9, 2016.

*Primary Examiner* — Sonia Gay
(74) *Attorney, Agent, or Firm* — Howard & Howard Attorneys PLLC

(57) ABSTRACT

To respond to an n-bit digital signal, a speaker (1) is provided that includes an sound pressure generator (10) including $2^{i-1}$ piezoelectric elements (51, 52, and 53) for an i-th bit, and a total of $2^n-1$ stacked piezoelectric elements (51, 52, and 53). Due to divided vibration of the piezoelectric elements (51, 52, and 53), the speaker (1) has low directionality. Planar electrodes (80, 81, 82, and 83), to which voltage is applied, are provided between the piezoelectric elements (51, 52, and 53). By this means, all the piezoelectric elements can be driven using similar voltages, and high sound quality can be obtained without a problem of unit-to-unit differences between voltage sources.

7 Claims, 5 Drawing Sheets

(51) Int. Cl.

| | |
|---|---|
| ***H04R 7/04*** | (2006.01) |
| ***H04R 7/06*** | (2006.01) |
| ***H04R 3/00*** | (2006.01) |

(56) References Cited

U.S. PATENT DOCUMENTS

| | | | | |
|---|---|---|---|---|
| 2009/0110217 | A1* | 4/2009 | Yasuda | H03H 15/00<br>381/120 |
| 2011/0255718 | A1* | 10/2011 | Fukushima | H04R 17/00<br>381/190 |

FOREIGN PATENT DOCUMENTS

| | | | |
|---|---|---|---|
| JP | 09-266599 | A | 10/1997 |
| JP | 2000-174854 | A | 6/2000 |
| JP | 2006-197562 | A | 7/2006 |

* cited by examiner

SPEAKER FOR GENERATING SOUND BASED ON DIGITAL SIGNAL

CROSS-REFERENCE TO RELATED APPLICATIONS

This application is a U.S. National Phase of International Application No. PCT/JP2016/065205, filed on May 23, 2016, which claims the benefit of Japanese Patent Application No. 2015-110980, filed on May 30, 2015, the disclosures of which are hereby incorporated by reference in their entirety.

TECHNICAL FIELD

The present disclosure relates to a speaker for generation of sound on the basis of a digital signal.

BACKGROUND ART

A speaker is known that generates sound on the basis of a digital signal (for example, see Patent Literature 1). The digital speaker can achieve high sound quality due to a lack of deterioration of sound quality by an analog system from audio amps and the like during transmission to the speaker. Further, for small-sized equipment such as mobile phones, the use of a digital terminal is preferred from the standpoint of equipment design due to the digital terminal being smaller than an analog terminal (so-called pin jack), and thus digital speakers, which generate sound on the basis of a digital signal output from the digital terminal, are increasingly important.

A digital speaker requires an array of separate sound generating devices, a device for each bit of the inputted digital signal. However, due to speaker units using a permanent magnet and voice coil often being utilized conventionally as each of the sound generating devices, a problem occurs due to mutual induction between coils. Further, differences between the individual coils also cause a problem of decreased sound quality. Also miniaturization is difficult due to the requirement that the number of speaker units matches the bit count.

Further, in the conventional speaker unit, the voice coil is provided at the center of a cone, and directionality is relatively high due to the generation of sound pressure by piston-like vibration of the cone. Thus the conventional speaker unit is inherently inappropriate for lowering directionality and providing sound over a wide angle.

Further, Patent Literature 2 discloses a digital speaker in which the number of electrodes arranged on one piezoelectric element is the same as the bit count. Either the voltage applied to each electrode differs for the corresponding bit, or the surface area of each of the electrodes corresponds to the bit. However, Patent Literature 2 does not disclose a circuit applying a voltage to each of the electrodes, and enablement cannot be realized using the disclosed configuration. In particular, how voltage is applied to a central portion of the piezoelectric element is unclear. Further, the voltage of each bit is applied separately to the central portion and circumferential portion of the piezoelectric element, and thus frequency characteristics of each bit in the piezoelectric element are not uniform.

CITATION LIST

Patent Literature

Patent Literature 1: Unexamined Japanese Patent Application Kokai Publication No. 2000-174854.

Patent Literature 2: Unexamined Japanese Patent Application Kokai Publication No. H09-266599

SUMMARY OF INVENTION

Technical Problem

The object of the present disclosure is to provide a speaker that has high sound quality, has low directionality, and is capable of miniaturization.

Solution to Problem

The speaker of the present disclosure includes:

a signal division circuit for dividing an inputted digital signal into bit units;

n D/A converters for output of a voltage in the bit units based on n post-division digital signals divided by the signal division circuit, n being greater than or equal to 2; and a sound pressure generator, including $2^n-1$ stacked piezoelectric elements, for receiving the voltage output from the D/A converters.

Maximum output voltages of the n D/A converters are the same, and the sound pressure generator includes $2^{i-1}$ of the piezoelectric elements for receiving the voltage output from the D/A converters processing the post-division digital signal for an i-th order bit from a lower order bit of the digital signal. Here, i is an integer ranging from 1 to n.

In this configuration, vibration of the sound pressure generator generates sound. The site of vibration is distributed over all the individual piezoelectric elements during generation of the sound, and thus low directionality can be achieved. Further, the piezoelectric elements of the sound pressure generator can be designed to have any desired size and shape, thereby enabling miniaturization.

Further, vibration is generated by the piezoelectric elements, and thus mutual induction between coils is not a problem. Further, due to the maximum output voltages being equal for the D/A converters, a single voltage source can be used, and the problem of unit-to-unit differences between the D/A converters can be eliminated. Thus high sound quality can be obtained.

Further, the piezoelectric elements vibrate by divided vibration rather than bending vibration, and thus high directionality is difficult to achieve.

In the speaker of the present disclosure, the sound pressure generator includes n through-hole electrodes corresponding to the n D/A converters, and the i-th through-hole electrode (i=1, . . . n) applies to $2^{i-1}$ of the piezoelectric elements the voltage output from a D/A converter of the D/A converters processing the post-division digital signal for the i-th order bit from the lower order bit of the digital signal (i=1, . . . n).

Due to this configuration, voltage can be applied through the through-hole electrode to specific piezoelectric elements among the stacked piezoelectric elements.

The speaker of the present disclosure includes planar electrodes disposed between the $2^{i-1}$ piezoelectric elements of the sound pressure generator. Planar electrodes to which the voltage is applied from the through-hole electrode, and planar electrodes to which the voltage is not applied from the through-hole electrode, are alternatingly disposed.

Due to this configuration, the voltage from the through-hole electrode can be applied through the planar electrode to 2 piezoelectric elements contacting the planar electrode.

In the speaker of the present disclosure, 2 or more of the sound pressure generators are bonded together via a flexible resin.

Due to this configuration, speakers with high sound pressure can be provided.

In the speaker of the present disclosure, the flexible resin is bent to form a cylindrical shape.

Due to this configuration, a speaker can be provided that has extremely low directionality.

Advantageous Effects of Invention

According to the present disclosure, a speaker can be provided that has high quality and low directionality, and is capable of miniaturization.

DESCRIPTION OF EMBODIMENTS

Two embodiments of a speaker are described below.

Embodiment 1

Figure 1:
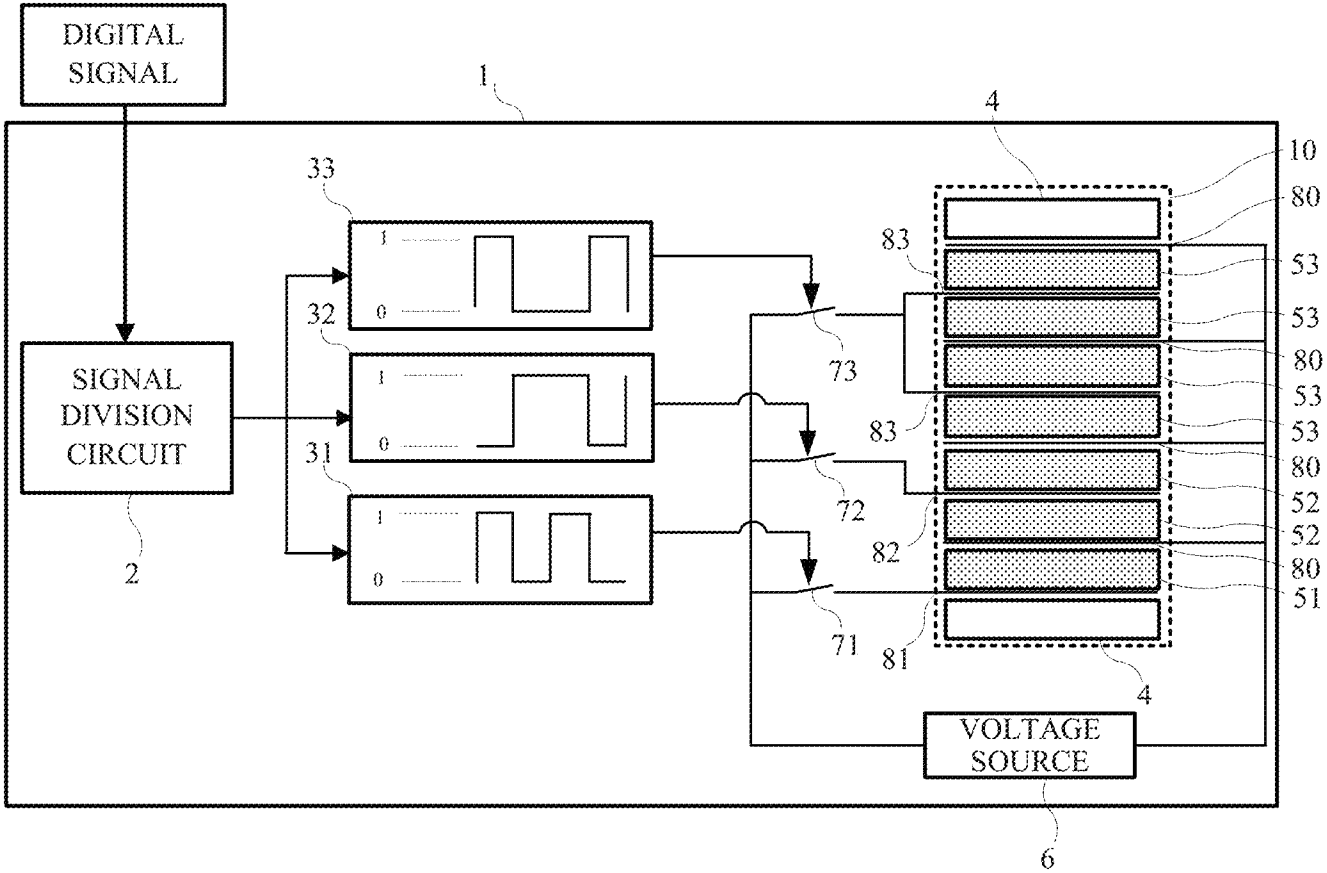
FIG. 1 is a drawing illustrating a configuration of a speaker.

FIG. 1 is a drawing illustrating a configuration of the speaker. A speaker 1 is configured to include a signal division circuit 2, an insulator 4, piezoelectric elements 51, 52, and 53, a voltage source 6, switches 71, 72, and 73, and planar electrodes 80, 81, 82, and 83.

The signal division circuit 2 divides an inputted digital signal into bit units and generates post-division digital signals 31, 32, and 33. The post-division digital signal 31 is a signal indicating a lowest-order bit, the post-division digital signal 32 is a signal indicating a middle-order bit, and the post-division digital signal 33 is a signal indicating a highest-order bit. Although the digital signal is used as a 3-bit signal in the present embodiment, the digital signal may have 4 or more bits.¥

The piezoelectric elements 51, 52, and 53 convert voltage to force. The piezoelectric element 51 corresponds to the post-division signal 31 of the lowest-order bit, the piezoelectric element 52 corresponds to the post-division signal 32 of the middle-order bit, and the piezoelectric element 53 corresponds to the post-division signal 33 of the highest-order bit. The piezoelectric elements 51, 52, and 53, for example, are formed from a ceramic such as lead zirconate titanate (PZT) or the like. Further, the piezoelectric elements 51, 52, 53 may also be thin film piezoelectric elements in a micro-electro-mechanical system (MEMS).

The piezoelectric elements 51, 52, and 53 are stacked. The insulators 4 are arranged to the exterior of the piezoelectric elements that are positioned at both ends when the piezoelectric elements are stacked. The planar electrodes 80, 81, 82, and 83 are sandwiched between the insulator 4 and the piezoelectric element, and are sandwiched between pairs of the piezoelectric elements.

A total number of the piezoelectric elements 51, 52, and 53 is $2^n_-1$ to correspond to the n bit units of the post-division digital signal, where n is an integer greater than or equal to 2. In the present embodiment, the post-division digital signal has 3 bits, and thus the total number of the piezoelectric elements 51, 52, and 53 is $2^3-1=7$. Further, the number of the piezoelectric element 51, 52, or 53 corresponds to a magnitude of a value expressed by the respective bit, and this number is 1, 2, or 4, respectively. This number is a result of setting the number of piezoelectric elements corresponding to the i-th bit from a lower order of the post-division digital signal to be $2^{i-1}$.

The piezoelectric elements 51, 52, and 53, insulator 4, and the planar electrodes 80, 81, 82, and 83 are included in a sound pressure generator 10. Thickness of each of the piezoelectric elements 51, 52, and 53 is about 150 μm in the case of PZT, and thickness of the sound pressure generator 10 that combines 7 piezoelectric elements 51, 52, and 53 and two insulators 4 is about 1.5 mm. Further, although the piezoelectric element is drawn with a square shape in the figure, the piezoelectric element may have a different shape, such as a circular shape, hexagonal shape, or the like.

The voltage source 6 is a voltage source to applying voltage to the piezoelectric elements 51, 52, and 53. In the present embodiment, voltage from one voltage source 6 is applied to all the piezoelectric elements 51, 52, and 53. Significance of this configuration is described below.

The switches 71, 72, and 73 perform ON-OFF switching of the voltage supply from the voltage source 6 to the piezoelectric elements 51, 52, and 53. The switches 71, 72, and 73 are used as electrical switches that are electrically opened and closed.

The post-division digital signals 31, 32, and 33 of each of the bit units indicate a value of 0 or 1 that changes with the passage of time. Thus if the switch 71, 72, or 73 is used as ON when the value of the post-division digital signal 31, 32, or 33 is 1, and is used as OFF when the value of the post-division digital signal 31, 32, or 33 is 0, the switches 71, 72, and 73 (and the voltage source 6) form a D/A converter. Thus the switch 71 operates as the D/A converter for processing the post-division digital signal 31 for the first bit from the bottom order of the digital signal, the switch 72 operates as the D/A converter for processing the post-division digital signal 32 for the second bit from the bottom order of the digital signal, and the switch 73 operates as the D/A converter for processing the post-division digital signal 33 for the third bit from the bottom order of the digital signal. The switches 71, 72, and 73 are provided on the basis of the number of the post-division digital signals, and thus the number of switches is n when n post-division digital signals are present (n is an integer greater than or equal to 2).

Operation of the speaker 1 is described below.

The digital signal has a prescribed bit count, is sampled at a certain frequency, and is numerical time series data indicating volume. The signal division circuit 2 divides the digital signal into bit units, and generates the post-division digital signals 31, 32, and 33. The post-division digital signals 31, 32, and 33 are sampled at the prescribed frequency to become numerical time series data indicating a value of 0 or 1.

In the speaker 1, when the value of the post-division digital signal 31, 32, or 33 is 1, the respective switch 71, 72, or 73 is turned ON, and when the value of the post-division digital signal 31, 32, or 33 is 0, the respective switch 71, 72, or 73 is turned OFF.

When the switches 71, 72, and 73 are turned ON, the voltage of the voltage source 6 is applied to the planar electrodes 81, 82, and 83. The configuration for application of the voltage is described below.

The number of the planar electrodes 81, 82, or 83 corresponds to magnitude of a value expressed by the respective bit, and thus the sound pressure generator 10 vibrates so as to generate sound pressure corresponding to the value of the digital signal. Sound pressure is generated that corresponds to the value of the digital signal.

In the aforementioned manner, the value of the digital signal undergoes D/A conversion by bit units, and sound pressure is generated that corresponds to a total of the values of all the bits. Further, in the D/A conversion, a separate D/A converter may be used for each of the bit units. In this case, a risk remains that sound quality may deteriorate on the basis of unit-to-unit differences between the D/A converters. In the configuration of the present embodiment, one voltage source 6 is used, and thus the maximum output voltages of the D/A converters are equal, and deterioration of sound quality due to unit-to-unit differences between the D/A converters does not occur. That is to say, even if the voltage of the voltage source 6 varies, the voltage varies uniformly for all of the piezoelectric elements 51, 52, and 53, and thus although the volume changes, sound quality does not deteriorate.

The sound pressure generator 10, whether fixed or not, vibrates autonomously, and thus although a speaker that uses a cone is fixed at a circumferential edge, such fixing at the circumferential edge is not necessarily required for the sound pressure generator 10. By mounting on a plate, for example, a main oscillation generating sound is a divided vibration rather than a bending vibration, and directionality is lower than that of a sound-generating mechanism using the bending vibration.

The configuration applying the voltage to the planar electrodes 80, 81, 82, and 83 and the piezoelectric elements 51, 52, and 53 is described below.

Figure 2A:
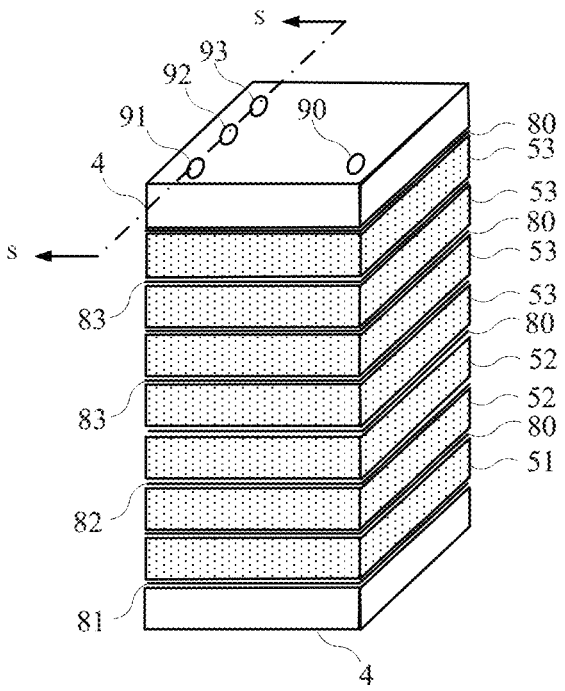
FIG. 2A is a tilted perspective view illustrating a configuration of electrodes.
Figure 2B:
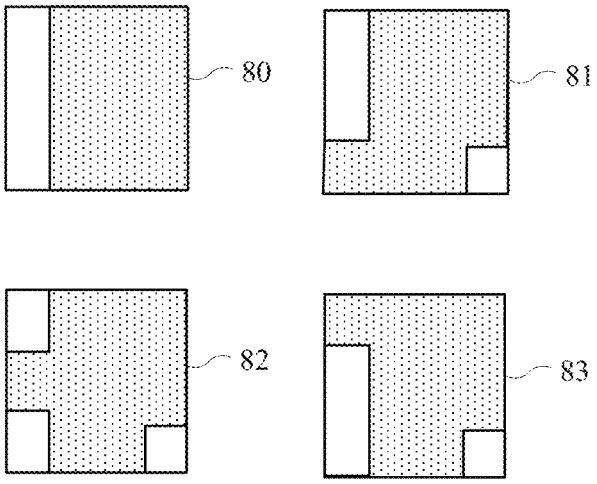
FIG. 2B is a top view of each of the electrodes.
Figure 2C:
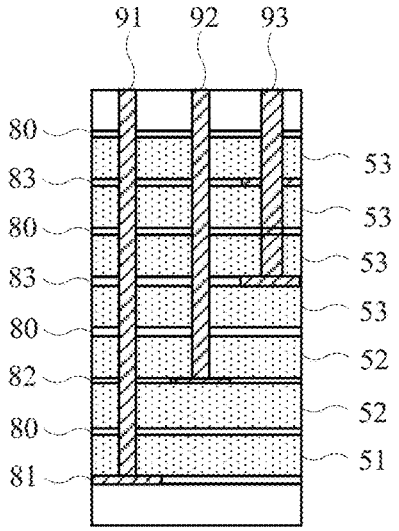
FIG. 2C is a cross-sectional view taken along line S-S in FIG. 2A.

FIG. 2A to FIG. 2C are drawings illustrating the configuration of the electrodes. As illustrated in FIG. 2A, the sound pressure generator 10 includes through-hole electrodes 90, 91, 92, and 93. One pole of the voltage source 6 is connected to the through-hole electrode 90. The other pole of the voltage source 6 is connected to the through-hole electrodes 91, 92, and 93 via the switches 71, 72, and 73.

The planar electrodes provided between the piezoelectric elements are arranged as the planar electrodes 81, 82, and 83 with the planar electrodes 80 arranged therebetween. The piezoelectric element 51 is sandwiched by the planar electrode 80 and the planar electrode 81, the piezoelectric element 52 is sandwiched by the planar electrode 80 and the planar electrode 82, and the piezoelectric element 53 is sandwiched by the planar electrode 80 and the planar electrode 83.

The planar electrodes 80, 81, 82, and 83 are illustrated in FIG. 2B. FIG. 2B illustrates the planar electrodes 80, 81, 82, and 83 as viewed downward from above FIG. 2A (viewed in the direction, from the insulator 4 in which the through-hole electrodes 90 to 93 shown in FIG. 2A are arranged, toward the other insulator 4), conductive components are indicated by hatching, and insulating components are indicated without hatching. One of the through-hole electrodes 90, 91, 92, and 93 has a conductive portion at a single penetration location, and the other locations are an insulating portion. Thus on the basis of the location of the conductive portion, the through-hole electrode 90 contacts the planar electrode 80, the through-hole electrode 91 contacts the planar electrode 81, the through-hole electrode 92 contacts the planar electrode 82, and the through-hole electrode 93 contacts the planar electrode 83. Further, as illustrated in FIG. 2C, just a sufficient length of the through-hole electrode to enable reaching the contacted planar electrode may be provided, and the lower tip of the through-hole electrode is not necessarily required to reach the piezoelectric element. FIG. 2C is a cross-sectional view taken along line S-S in FIG. 2A.

In accordance with the aforementioned structure, the voltage of the voltage source 6 is applied to the piezoelectric element 51 when the switch 71 is turned ON, the voltage of the voltage source 6 is applied to the piezoelectric element 52 when the switch 72 is turned ON, and the voltage of the voltage source 6 is applied to the piezoelectric element 53 when the switch 73 is turned ON.

Further, the order of stacking of the piezoelectric elements 51, 52, and 53 is not limited to the order of stacking of the present embodiment, and the order of stacking may be determined as desired. Various types of ordering of the stacking of the piezoelectric elements 51, 52, and 53 are possible as long the ordering of the stacking results in the configuration of the present embodiment that applies voltage by the through-hole electrodes and the planar electrodes. For example, a configuration is possible that, by stacking in order from top to bottom as 51, 53, 53, 52, 52, 53, and 53, does not consecutively stack 4 of the piezoelectric elements 53.

As described in detail above, the speaker 1 of the present embodiment includes the signal division circuit 2, the insulators 4, the piezoelectric elements 51, 52, and 53, the voltage source 6, the switches 71, 72, and 73, and the planar electrodes 80, 81, 82, and 83. Sound pressure is generated by divided vibration of the sound pressure generator 10, and low directionality is achieved. Further, due to D/A conversion by the switches 71, 72, and 73 using one voltage source 6, deterioration of sound quality due to unit-to-unit differences of the devices does not occur. Further, voice coils are not used, and thus the problem of mutual interference between multiple coils does not occur. Therefore in the speaker 1 of Embodiment 1, a speaker is achieved that has high sound quality and low directionality. Further, the size and the shape of the piezoelectric elements 51, 52, and 53 can be designed freely as desired, and the speaker 1 of the present Embodiment 1 can be miniaturized.

Embodiment 2

Although in Embodiment 1 an embodiment is described of an oscillator structure serving as a basis of the present disclosure, the present embodiment describes a method for further increasing sound pressure over the sound pressure of the single-unit oscillator. The present embodiment uses 2 or more sound pressure generators 10 of the speaker 1 illustrated in Embodiment 1, and generates divided vibration having a high sound pressure. The structure of the sound pressure generator 10 is similar to that of Embodiment 1, and detailed description thereof is omitted.

Figure 3:
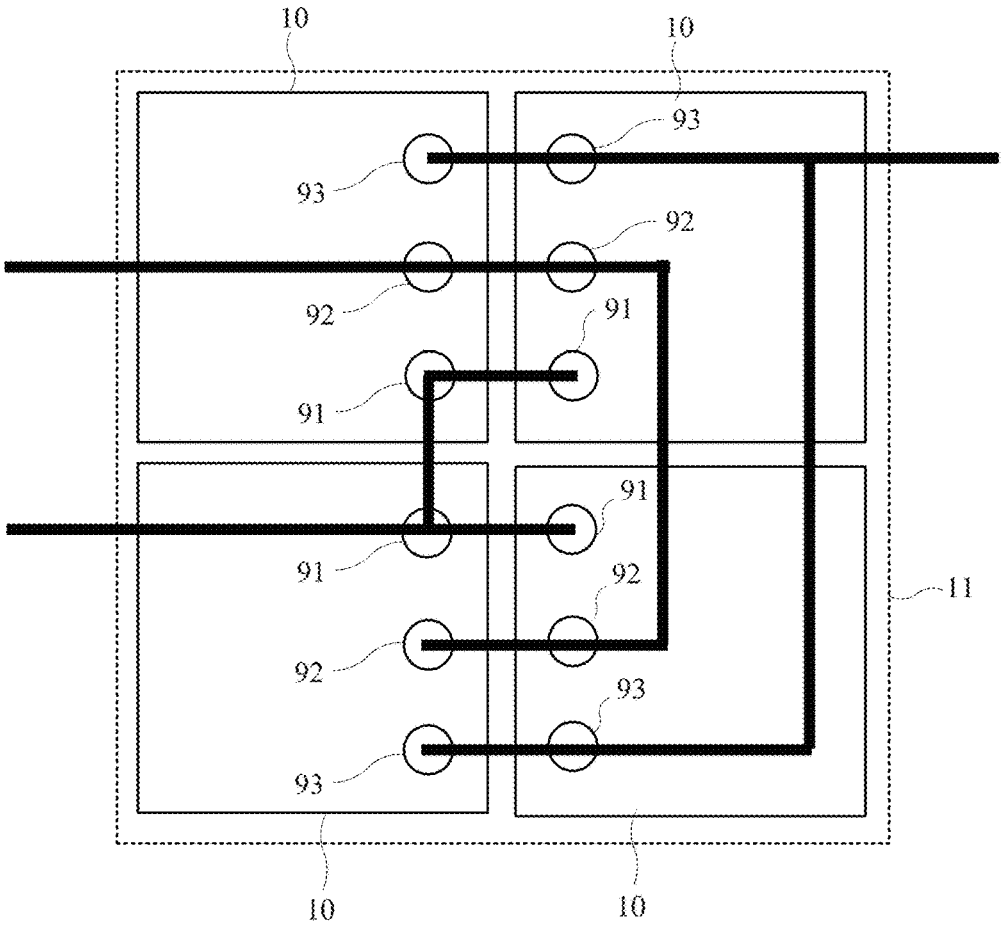
FIG. 3 is a drawing illustrating a configuration of a high sound pressure generator.

FIG. 3 is a drawing illustrating a configuration of a high sound pressure generator. The 4 sound pressure generators 10 are covered by the resin 11 and define a common surface in which the through-hole electrodes are arranged. The utilized resin 11 is flexible and does not hinder vibration of the speaker 1. For example, the state illustrated in FIG. 3 is achieved by applying the resin 11 and allowing the resin 11 to cure.

After curing of the resin 11, the surface is polished, and the through-hole electrodes 91, 92, and 93 are exposed. Interconnections are made to the 4 through-hole electrodes 91 by a method such as printing or sputtering. When the switch 71 is turned ON, the voltage is input to this interconnect. The through-hole electrodes 92 and 93 are similarly connected. Although similarly connected, the through-hole electrode 90 is omitted for ease of understanding drawings.

The resin 11 is flexible, and thus all of the 4 sound pressure generators 10 and the resin 11 flexibly bend and generate divided vibration.

In the aforementioned manner, the high sound pressure generator configured from the 4 sound pressure generators 10 (illustrated in FIG. 3) is used in the speaker of FIG. 1 as a single sound pressure generator.

By this means, the speaker of Embodiment 2 can obtain high sound pressure. Further, although an example is indicated using 4 sound pressure generators 10, any desired number of the sound pressure generators 10 can be used. An example is described below of the use of a multiplicity of the sound pressure generators 10.

Figure 4A:
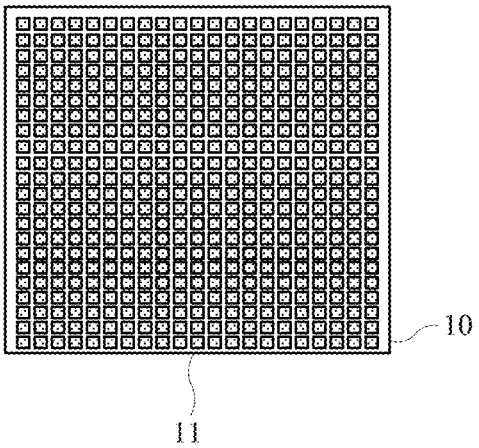
FIG. 4A is a drawing illustrating flexing of the speaker.
Figure 4B:
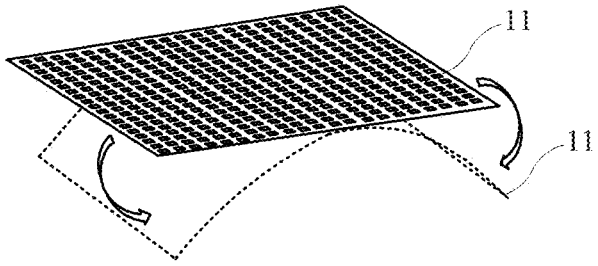
FIG. 4B is a drawing illustrating bending of a resin.
Figure 4C:
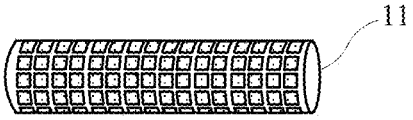
FIG. 4C is a drawing illustrating a cylindrical sound pressure generator.

In FIG. 4A to FIG. 4C, drawings illustrate bending of the speaker. As illustrated in FIG. 4A, a multiplicity of the sound pressure generators 10 is arranged on a single sheet of the resin 11. The sound pressure generator 10 has a 2 mm square shape. A total of 462 sound pressure generators 10 are used, that is, 22 rows in the length-wise direction, and 21 columns in the lateral direction. The overall size of the resin 11 is 45 mm×47 mm, including the edges. Further, the through-hole electrodes and the interconnects are not illustrated.

Due to bendability (flexibility) of the resin 11, the resin 11 can bend as illustrated in FIG. 4B. Width of the sound pressure generator 10 is small, about 2 mm, and thus the sound pressure generators 10 do not hinder overall bending of the resin 11. Further, although size of the sound pressure generator 10 may be selected by design, in order not to hinder overall bending of the resin 11, length (radius) of the sound pressure generator 10 along a bending direction of the resin 11 is preferably less than or equal to 3 mm.

As illustrated in FIG. 4C, the sound pressure generators 10 can be formed into a cylindrical shape. When configured in this manner, the sound pressure generators 10 face outwardly over a central angle range of 360° entirely. Although the sound pressure generators 10, due to divided vibration, have intrinsically low directionality, the directionality can be further decreased by the sound pressure generators 10 facing outwardly over the central angle range of 360°.

Figure 5:
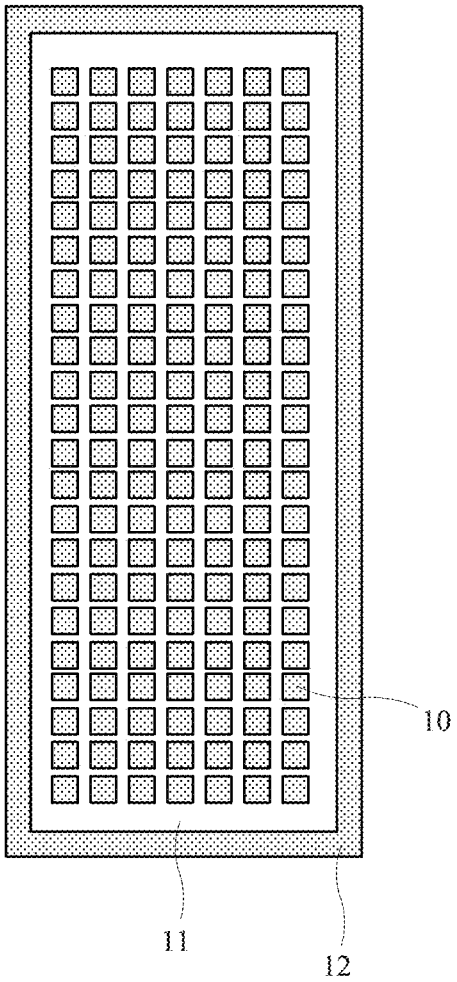
FIG. 5 is a drawing illustrating an example of the speaker.

FIG. 5 is a drawing illustrating an example of the speaker. On a single sheet of the resin 11, a total of 154 sound pressure generators 10 are used, that is, 22 rows in the length-wise direction, and 7 columns in the lateral direction. The sound pressure generators 10 each have a 2 mm square shape. The overall size of the resin 11 is 15 mm×47 mm, including the edges.

The resin 11 is attached to the frame 12. The frame 12 is 0.5 mm thick and is made of metal.

Then the piezoelectric elements and the planar electrodes of the sound pressure generator 10 are formed as a micro-electro-mechanical system (MEMS), and when a 3-bit signal is processed, thickness of a single sound pressure generator 10 formed as a MEMS is about 1 μm, and thus the sound pressure generator 10 formed by 7 layers of MEMS can be formed with a thickness of about 7 μm. Overall thickness of the speaker is nearly equal to 0.5 mm, which is the thickness of the frame 12.

Further, when lead zirconate titanate (PZT) is used as the piezoelectric element, thickness of PZT is about 100 to 150 μm, and thus suppression of thickness (overall speaker thickness) of the sound pressure generator 10 is difficult.

In the aforementioned manner, a speaker is constructed that is miniaturized and thin, and is capable of obtaining high sound pressure. This speaker can be used with advantage by attachment to a device such as a mobile phone.

As described above in detail, a speaker of the present embodiment can be obtained that is miniaturized and thin, and is able to obtain high sound pressure and low directionality.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2015-110980, filed on May 30, 2015, including the specification, claims, and drawings, the entire disclosure of which is incorporated by reference herein.

INDUSTRIAL APPLICABILITY

The present disclosure is considered for many audio equipment manufacturers to have applications related to digital speakers, speaker systems, and earphones that are miniaturized and have high sound quality.

REFERENCE SIGNS LIST

1 Speaker
2 Signal division circuit
31 Post-division digital signal
32 Post-division digital signal
33 Post-division digital signal
4 Insulator
51 Piezoelectric element
52 Piezoelectric element
53 Piezoelectric element
6 Voltage source
71 Switch
72 Switch
73 Switch
80 Planar electrode
81 Planar electrode
82 Planar electrode
83 Planar electrode
90 Through-hole electrode
91 Through-hole electrode
92 Through-hole electrode
93 Through-hole electrode
10 Sound pressure generator
11 Resin
12 Frame

The invention claimed is:

1. A speaker comprising:

a signal division circuit for dividing an inputted digital signal into bit units;

n D/A converters for output of a voltage in the bit units based on n post-division digital signals divided by the signal division circuit, n being greater than or equal to 2; and a sound pressure generator, including $2^n-1$ stacked piezoelectric elements, for receiving the voltage output from the D/A converters, wherein maximum output voltages of the n D/A converters are the same, and the sound pressure generator includes $2^{i-1}$ of the piezoelectric elements for receiving the voltage output from the D/A converters processing the post-division digital signal for an i-th order bit from a lower order bit of the digital signal, i being an integer ranging from 1 to n, and includes n through-hole electrodes corresponding to the n D/A converters.

2. A speaker comprising:

a signal division circuit for dividing an inputted digital signal into bit units;

n D/A converters for output of a voltage in the bit units based on n post-division digital signals divided by the signal division circuit, n being greater than or equal to 2; and a sound pressure generator, including $2^n-1$ stacked piezoelectric elements, for receiving the voltage output from the D/A converters, wherein maximum output voltages of the n D/A converters are the same, and the sound pressure generator includes $2^{i-1}$ of the piezoelectric elements for receiving the voltage output from the D/A converters processing the post-division digital signal for an i-th order bit from a lower order bit of the digital signal, i being an integer ranging from 1 to n, and includes n through-hole electrodes corresponding to the n D/A converters, and an i-th through-hole electrode applies to $2^{i-1}$ of the piezoelectric elements the voltage output from a D/A converter of the D/A converters processing the post-division digital signal for the i-th order bit from the lower order bit of the digital signal.

3. The speaker according to claim 2, wherein the sound pressure generator includes planar electrodes disposed between the $2^{i-1}$ piezoelectric elements of the sound pressure generator, and planar electrodes to which the voltage is applied from the through-hole electrode and planar electrodes to which the voltage is not applied from the through-hole electrode are alternatingly disposed.

4. The speaker according to claim 2, wherein 2 or more of the sound pressure generators are bonded together via a flexible resin.

5. The speaker according to claim 4, wherein the flexible resin is bent to form a cylindrical shape.

6. The speaker according to claim 3, wherein 2 or more of the sound pressure generators are bonded together via a flexible resin.

7. The speaker according to claim 6, wherein the flexible resin is bent to form a cylindrical shape.

* * * * *